US006980126B2

(12) United States Patent
Fournier

(10) Patent No.: US 6,980,126 B2
(45) Date of Patent: Dec. 27, 2005

(54) PHOTOCELL PEDESTRIAN BUTTON

(75) Inventor: Serge Fournier, St-Augustin-de-Desmaures (CA)

(73) Assignee: Logisig Inc., St-Augustin-de-Desmaures (CA)

( * ) Notice: Subject to any disclaimer, the term of this patent is extended or adjusted under 35 U.S.C. 154(b) by 97 days.

(21) Appl. No.: 10/674,545

(22) Filed: Oct. 1, 2003

(65) Prior Publication Data

US 2004/0075584 A1 Apr. 22, 2004

Related U.S. Application Data

(60) Provisional application No. 60/416,550, filed on Oct. 8, 2002.

(51) Int. Cl.[7] ..... G08G 1/07

(52) U.S. Cl. ..... 340/925; 340/944; 340/929; 340/407.1; 340/384.1; 4/623; 4/628; 4/643

(58) Field of Search ..... 340/925, 944, 340/929, 407.1, 384.1; 4/623, 628, 643

(56) References Cited

U.S. PATENT DOCUMENTS

| | | | | |
|---|---|---|---|---|
| 4,187,418 | A * | 2/1980 | Harris | 200/295 |
| 5,125,482 | A * | 6/1992 | Negishi | 188/73.38 |
| 5,920,050 | A * | 7/1999 | Tolman | 200/302.2 |
| 2004/0226962 | A1 * | 11/2004 | Mazursky et al. | 222/95 |

* cited by examiner

*Primary Examiner*—Daniel Wu
*Assistant Examiner*—Tai T. Nguyen
(74) *Attorney, Agent, or Firm*—Ogilvy Renault LLP

(57) ABSTRACT

A unit for pedestrian control of traffic lights operated by a traffic light controller, comprises a casing adapted to be mounted to a traffic light post, the casing having a bottom face carrying a window, and a photocell mounted in the casing for directing a beam through the window in a downward direction generally parallel to the post to which the casing is mounted. The photocell is responsive to the presence of a pedestrian's hand placed beneath the window in the beam. The photocell is adapted to be operatively connected to the traffic light controller to send a signal thereto when the presence of a pedestrian has been detected.

14 Claims, 2 Drawing Sheets

PHOTOCELL PEDESTRIAN BUTTON

This application claims the benefit of Provisional application No. 60/416,550, filed Oct. 8, 2002.

BACKGROUND OF THE INVENTION

1. Field of the Invention

The present invention relates generally to devices for the actuation of traffic signals and, more particularly, to a light-sensitive pedestrian button.

2. Description of the Prior Art

Pedestrian push-buttons by means of which a pedestrian can turn traffic lights to red to allow the pedestrian to walk safely across a street are well known. Such pedestrian control devices commonly include a spring-biased control button that must be pressed by a pedestrian to send a signal to a traffic signal controller which will detect that a pedestrian requires time to cross the street. The spring-biased button is typically operatively connected to a switch which is, in turn, connected to the traffic signal controller.

It has been found that there is currently a need for an improved traffic signal actuator that could advantageously replace the conventional pedestrian push-button.

SUMMARY OF THE INVENTION

It is therefore an aim of the present invention to provide a new traffic signal actuator that can be operated by a pedestrian to send a control command to a traffic signal controller.

It is also an aim of the present invention to provide such a traffic signal actuator which is reliable and easy to operate.

Therefore, in accordance with the present invention, there is provided a unit for pedestrian control of traffic lights operated by a traffic light controller, comprising a casing adapted to be mounted to a traffic light post, said casing having a bottom face carrying a window, and a photocell mounted in said casing for directing a beam through said window in a downward direction generally parallel to the post to which the casing is mounted, said photocell being responsive to the presence of a pedestrian's hand placed beneath said window in said beam, and wherein said photocell is adapted to be operatively connected to the traffic light controller to send a signal thereto when the presence of a pedestrian has been detected.

In accordance with a further general aspect of the present invention, there is provided a unit for pedestrian control of traffic lights operated by a traffic light controller, comprising a casing adapted to be mounted to a traffic light post, said casing having a bottom face, a sensor mounted in said casing for detecting the presence of a pedestrian's hand immediately underneath said bottom face, and wherein said sensor is adapted to be operatively connected to the traffic light controller to send a signal thereto when the presence of a pedestrian has been detected.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
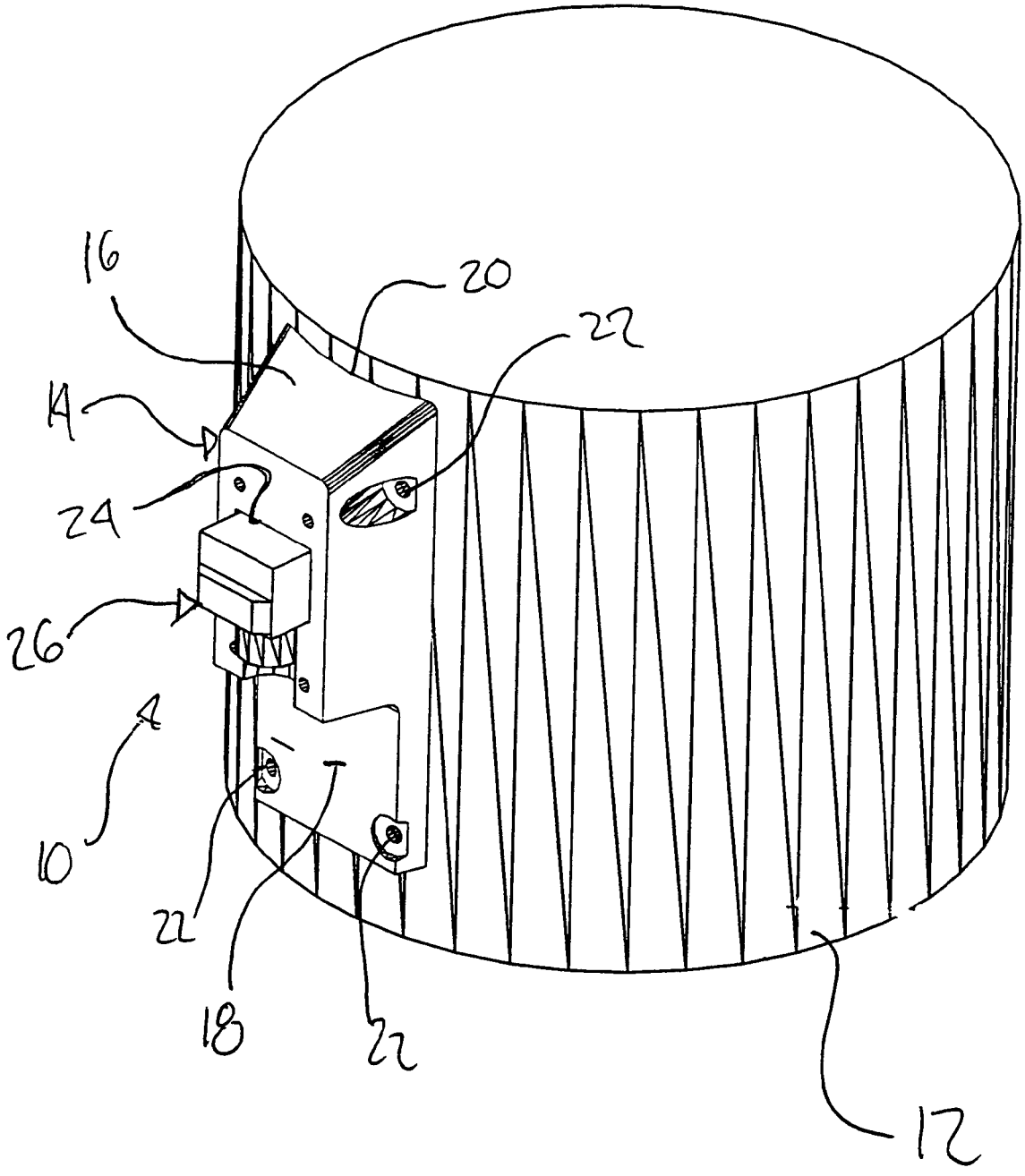
FIG. 1 is a perspective view of a pedestrian traffic control unit mounted to a traffic light post in accordance with a preferred embodiment of the present invention, part of the casing of the unit being omitted for clarity.

Now referring to the drawings, FIG. 1 illustrates a pedestrian traffic control unit 10 mounted to a post 12, such as the ones located at road intersections to support traffic lights. The unit 10 is adapted to be operatively connected to a conventional traffic light controller (not shown) for allowing a pedestrian to turn the traffic lights to red, thereby allowing the pedestrian to cross the street safely.

Figure 2:
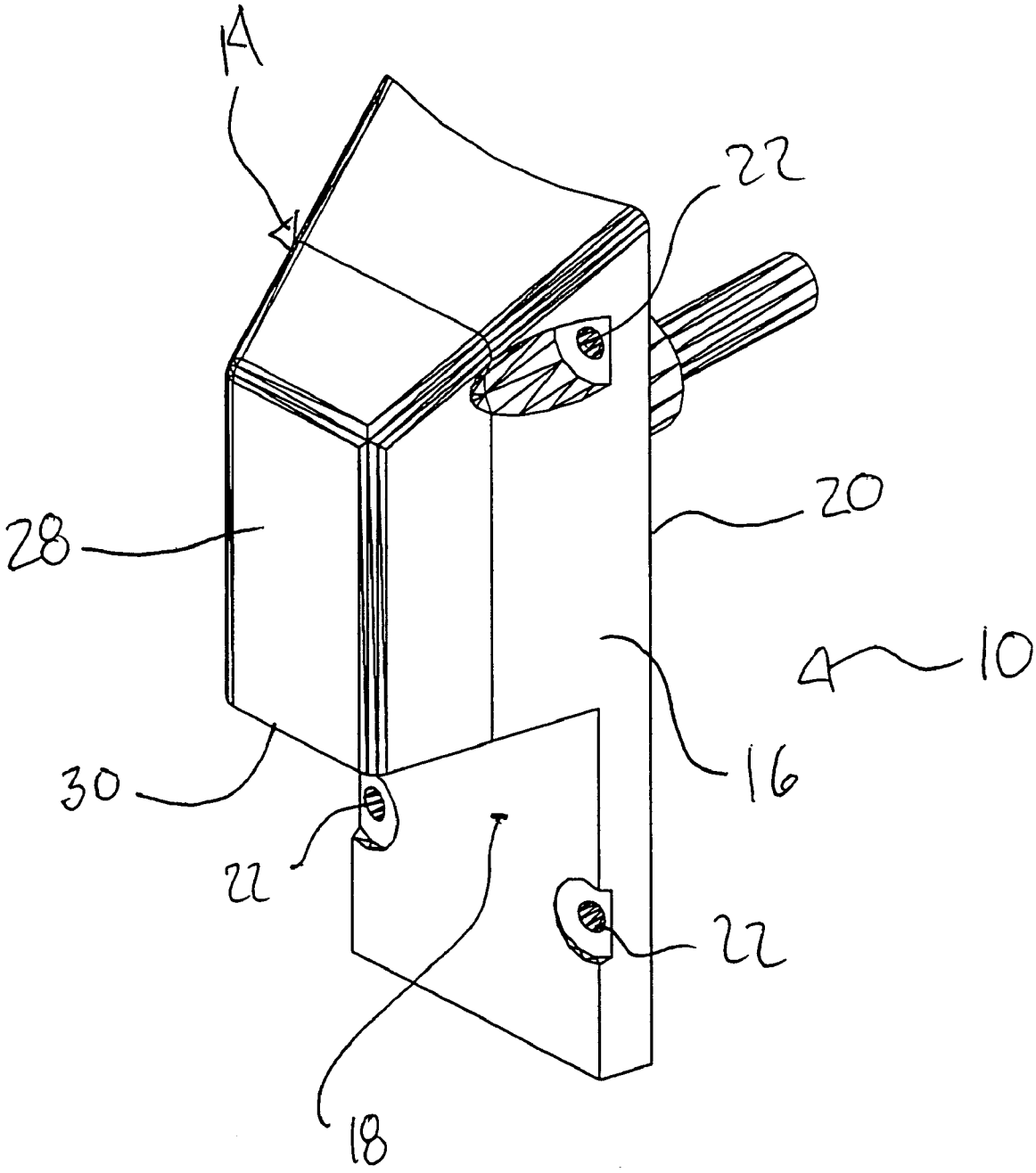
FIG. 2 is a perspective view of the casing once assembled.

As shown in FIGS. 1 and 2, the unit 10 comprises a casing 14, preferably of glazed polycarbonate or the like, including a saddle 16 formed with a stepped front face 18 and a semi-cylindrical back face 20 having a radius of curvature generally corresponding with that of the post 12 to which the unit is mounted. Four threaded holes 22 are defined at the corners of the saddle 16 for receiving threaded fasteners in order to fixedly secure the saddle 16 to the post 12. As shown in FIG. 1, a recess 24 is defined in the upper portion of the front face 18 for receiving a photoelectric cell 26 (also known as photocell and light-sensitive cell). According to a preferred embodiment of the present invention, a #42EF-B1RCBC-A2 photoelectric cell is used.

The casing 14 further includes a cover 28 (FIG. 2) which is adapted to be mounted to the saddle 16 for protecting the photoelectric cell 26. The cover 28 is preferably mounted to the front face of the saddle 16 by means of four threaded fasteners (not shown) to provide easy access to the cell 26 if need be. The cover 28 has a bottom face 30 carrying a polished window (not shown) through which the indicators of the cell 26 can be viewed.

The photoelectric cell 26 is mounted in the casing 14 so that the light beam thereof by directed downwardly in parallel to the longitudinal axis of the post 12. A pictogram can be incorporated in the casing 14 for indicating the location of the detecting field of the cell 26. Also, it is contemplated to provide three ultra-bright electro-luminous red indicators #63108 in the casing 14.

A fan and a downwardly-directed air outlet could also be provided in the casing to prevent light elements, such as snow or leaf carried by the wind, from crossing the detection field of the cell 26, which would otherwise result in the activation of the unit 10.

The unit 10 could also comprise an indicator light or a vibrating member to provide a visual or tactical indication to the pedestrian that his/her presence has been detected and that a control command has been send by the unit 10 to the traffic light controller.

To actuate the unit 10, the pedestrian has solely to place one of his/her hands beneath the window of the cover 28 in the beam of the photoelectric cell 26. The cell 26 will detect the pedestrian presence and send a signal to the traffic light controller to turn the traffic lights to red for a period of time sufficient for the pedestrian to cross the intersection.

What is claimed is:

1. A unit for pedestrian control of traffic lights operated by a traffic light controller, comprising a casing adapted to be mounted to a traffic light post, said casing having a bottom face carrying a window, and a photocell mounted in said casing for directing a beam through said window in a downward direction generally parallel to the post to which the casing is mounted, said photocell being responsive to the presence of a pedestrian's hand placed beneath said window in said beam, and wherein said photocell is adapted to be operatively connected to the traffic light controller to send a signal thereto when the presence of a pedestrian has been detected.

2. A unit as defined in claim 1, wherein said casing comprises a saddle having a stepped front surface including an upper portion and a lower portion, the lower portion being recessed relative to the upper portion, and wherein a recess is defined in the upper portion for receiving said photocell.

3. A unit as defined in claim 2, wherein said saddle has a back face having a curvature generally corresponding to a curvature of the traffic light post to which the unit is to be mounted.

4. A unit as defined in claim 2, wherein the casing further includes a cover adapted to be removably mounted to the saddle for protecting the photocell.

5. A unit as defined in claim 4, wherein said window is carried by said cover.

6. A unit as defined in claim 1, wherein a pictogram is incorporated in the casing for indicating the location of a detecting field of the photocell.

7. A unit as defined in claim 1, further comprising a fan mounted within the casing, and a downwardly-directed air outlet defined in the casing, the air pushed through the air outlet by the fan preventing light elements from crossing the detection field of the photocell.

8. A unit for pedestrian control of traffic lights operated by a traffic light controller, comprising a casing adapted to be mounted to a traffic light post, said casing having a bottom face, a photocell sensor mounted in said casing for detecting the presence of a pedestrian's hand immediately underneath said bottom face, and wherein said sensor is adapted to be operatively connected to the traffic light controller to send a signal thereto when the presence of a pedestrian has been detected.

9. A unit as defined in claim 8, wherein said casing comprises a saddle having a stepped front surface including an upper portion and a lower portion, the lower portion being recessed relative to the upper portion, and wherein a recess is defined in the upper portion for receiving said photocell.

10. A unit as defined in claim 9, wherein said saddle has a back face having a curvature generally corresponding to a curvature of the traffic light post to which the unit is to be mounted.

11. A unit as defined in claim 9, wherein the casing further includes a cover adapted to be removably mounted to the saddle for protecting the photocell.

12. A unit as defined in claim 11, wherein said window is carried by said cover.

13. A unit as defined in claim 8, wherein a pictogram is incorporated in the casing for indicating the location of a detecting field of the photocell.

14. A unit as defined in claim 8, further comprising a fan mounted within the casing, and a downwardly-directed air outlet defined in the casing, the air pushed through the air outlet by the fan preventing light elements from crossing the detection field of the photocell.

* * * * *